US005802815A

United States Patent [19]

Lohr et al.

[11] Patent Number: 5,802,815

[45] Date of Patent: Sep. 8, 1998

[54] PROCESS FOR THE SELF-SEALING OF CONTAINERS

[75] Inventors: Christoph Lohr, Dortmund; Krebs Michael, Hilden; Robert Magunia, Elztal-Dallau, all of Germany

[73] Assignee: Henkel Kommanditgesellschaft auf Aktien, Duesseldorf, Germany

[21] Appl. No.: 693,306

[22] PCT Filed: Feb. 6, 1995

[86] PCT No.: PCT/EP95/00415

§ 371 Date: Aug. 14, 1996

§ 102(e) Date: Aug. 14, 1996

[87] PCT Pub. No.: WO95/21767

PCT Pub. Date: Aug. 17, 1995

[30] Foreign Application Priority Data

Feb. 14, 1994 [DE] Germany ..... 44 04 631.6

[51] Int. Cl.[6] ..... B65B 55/14

[52] U.S. Cl. ..... 53/440; 53/423; 53/471

[58] Field of Search ..... 53/420, 423, 441, 53/442, 449, 467, 471, 473, 476, 485, 488, 489, 122, 127, 440; 206/447, 524.7

[56] References Cited

U.S. PATENT DOCUMENTS

| | | | |
|---|---|---|---|
| 3,545,643 | 12/1970 | Higgins et al. | 206/447 |
| 3,648,882 | 3/1972 | Shelton | 206/447 |
| 4,077,178 | 3/1978 | Nelson et al. | 53/420 |
| 4,807,746 | 2/1989 | Jacobs | 206/447 |
| 4,867,312 | 9/1989 | Comert et al. | 206/447 |
| 5,042,228 | 8/1991 | Pearson | 53/467 |
| 5,257,491 | 11/1993 | Rouger et al. | 53/473 |
| 5,373,682 | 12/1994 | Hatfield et al. | 206/524.7 |
| 5,392,592 | 2/1995 | Bozich et al. | 53/473 |

FOREIGN PATENT DOCUMENTS

| | | |
|---|---|---|
| 102 804 | 3/1984 | European Pat. Off. . |
| 280 634 | 8/1988 | European Pat. Off. . |
| 354 650 | 2/1990 | European Pat. Off. . |

*Primary Examiner*—Daniel Moon
*Assistant Examiner*—Ed Tolan
*Attorney, Agent, or Firm*—Wayne C. Jaeschke; John Daniel Wood; Steven J. Trzaska

[57] ABSTRACT

A process for filling and self-sealing containers with molten materials is provided. The process comprises filling a container with a molten material and covering the surface of the molten material which is still at elevated temperature after filling with an insert consisting of a plastic film and a plastic disk. The plastic film faces the molten material and is larger than the plastic disk. The diameter of the plastic disk is slightly smaller than the internal diameter of said container.

17 Claims, 1 Drawing Sheet

PROCESS FOR THE SELF-SEALING OF CONTAINERS

BACKGROUND OF THE INVENTION

1. Field of the Invention

This invention relates to a process for the self-sealing of tin containers and drums which may be used with advantage for fusible materials, more especially for moisture-reactive polyurethane hotmelts.

2. Discussion of Related Art

Moisture-reactive polyurethane hotmelts are formulated in such a way that they react even with traces with moisture and form crosslinked, infusible polymers. Accordingly, in the packaging and storage of polyurethane hotmelts, the moisture tightness of the containers used has to meet very stringent requirements, as demonstrated in the following. Around 1 kg of water is required for completely curing 1 kg of a polyurethane hotmelt containing 1% of isocyanate, i.e. for reacting all the isocyanate groups. Accordingly, a skin is formed on the surface of the hotmelt even if only fractions of this quantity of water reach the surface of the product.

Accordingly, in the packaging of polyurethane hotmelts in tin containers or drums, even traces of moisture diffusing into the container can render the entire contents thereof unusable as a result of skin formation.

In order, therefore, to ensure that the packaged polyurethane hotmelt has a storage life of 9 months or longer, the containers used have to meet stringent requirements, particularly in regard to the tightness of the seal used and in regard to dimensional stability. Since the tightness of the container cannot be satisfactorily tested, even with 100% incoming goods control, it happens fairly often in the present state of the art that individual containers are found to be leaking after packaging of the hotmelt. It is a considerable disadvantage in this regard that even the customer is unable to detect such defective containers because the crosslinked skin is impossible to distinguish from the uncrosslinked reactive hotmelt at room temperature. Although it is possible to melt the surface each time the container is changed and to determine whether a skin has already formed, this step is both labor-intensive and time-consuming, especially since, in industrial application, the time available to change a container is generally very short. In general, the processor only notices the formation of a skin in the container through a marked reduction in the amount of molten hotmelt transported through the plant. Since the skin can block the throughflow pipes, defective bonds and expensive, time-consuming breaks in production are the outcome.

There has been no shortage of attempts to develop suitable packs for reactive polyurethane hotmelts in which the skin formation and hardening mentioned above can be avoided. Thus, EP-A-102 804 describes a cylindrical container which is heated at its base and which is provided at its base with a removal opening and, at its upper end, with a displaceable piston head as closure. During removal of the hotmelt adhesive, the base of the container is heated so that the hotmelt is only melted at the base of the container. The plunger of a drum press applies pressure to the displaceable piston head of the container so that the entire non-melted block of hotmelt adhesive is pushed downwards and the molten part of the hotmelt adhesive is pressed through the removal opening to the applicator for the hotmelt adhesive connected to the removal opening. This solution has two major disadvantages. Firstly, it requires special containers with a lower outlet opening which are complicated and therefore expensive; secondly, application difficulties are involved where amorphous hotmelts are used. Whereas, in the case of hotmelt adhesives which are crystalline at room temperature, the considerable contraction which the adhesive undergoes on solidification results in the formation of a narrow gap between the wall of the container and the block of solid hotmelt adhesive composition, amorphous hotmelt adhesives shrink to a far lesser extent on solidification so that, in their case, the above-mentioned formation of a gap between the body of the hotmelt adhesive and the wall of the container often takes place to only a very limited extent. However, the gap in question promotes the mobility of the non-melted part of the block of hotmelt adhesive during the removal process so that considerable difficulties can arise in the application of amorphous hotmelt adhesives from containers of this type.

Accordingly, EP-B-354 650 proposes lining the adhesive container before it is filled with an inner bag of a heat-resistant film so that the hotmelt adhesive is unable to adhere to the wall of the container. If these inner bags, also known as inliners, consist of moisture-proof composite aluminium foil and are sealed after filling, the hotmelt adhesive is even afforded additional protection against moisture. However, these inliners have several disadvantages so that, hitherto, they have never been generally accepted. The main disadvantages of these inliners are:

High costs; standard inliners with polyethylene as the inner layer have only a limited heat resistance of around 80° C. In some cases, however, polyurethane hotmelts are packaged at considerably higher temperatures so that expensive heat-resistant special foils have to be used to produce the inliners.

The lining of the containers (drums or tin containers) with the inliners before filling and the sealing of the inliners after filling necessitate additional steps.

Considerable quantities of non-removable hotmelt adhesives remain in the inliners after emptying. In moisture-impermeable inliners, however, this residual material does not harden so that problems are involved in the disposal of the inliners contaminated with hotmelt adhesive.

Since the two processes described above do not always provide satisfactory results, a far simpler solution suggests itself: after the polyurethane hotmelt has been packed in the container, the surface of the melt is covered with a dimensionally accurate, moisture-proof film which the user removes from the then solid surface of the hotmelt immediately before application. This simple solution would be inexpensive and easy to implement in practice at little extra cost. The subsequent disposal of the film as waste would not involve any difficulties because it can be removed from the product without sticking. However, this approach has one major disadvantage in relation to the above-described solution using inliners. When the polyurethane melt cools in the tin container, it undergoes thermal shrinkage. In the case of crystalline hotmelts, additional shrinkage occurs through crystallization. The effect of this shrinkage is that the hotmelt generally separates from the wall of the container to a more or less considerable extent. A deep gap is thus formed between the wall of the container and the block of hotmelt adhesive. Although moisture, which diffuses into the container through any leaks present or which was present in the upper air space between the block of hotmelt and the lid of the container, is unable to reach most of the surface of the hotmelt because it is covered by the film, moisture is able to penetrate deeply through the gap at the wall of the container and leads to the formation of a skin there and hence to interruptions during application of the hotmelt.

SUMMARY OF THE INVENTION

Accordingly, the problem addressed by the present invention was to provide a sealing process with which moisture-sensitive fusible materials, more especially polyurethane hotmelts, could be packed in containers and would remain stable in storage for long periods.

According to the invention, the solution to this problem is characterized in that the surface of the fusible material—after introduction into the container to be sealed—is covered with an insert consisting of a plastic film and a plastic disk. The diameter of the plastic film used to cover the surface of the fusible material is larger than the internal diameter of the container to be sealed. The diameter of the plastic disk is slightly smaller than the internal diameter of the container. In general, the casks, tin containers or drums used for the fusible materials have a circular cross-section so that the cover film and the plastic disk are also circular in shape.

DETAILED DESCRIPTION OF THE INVENTION

Figure 1:
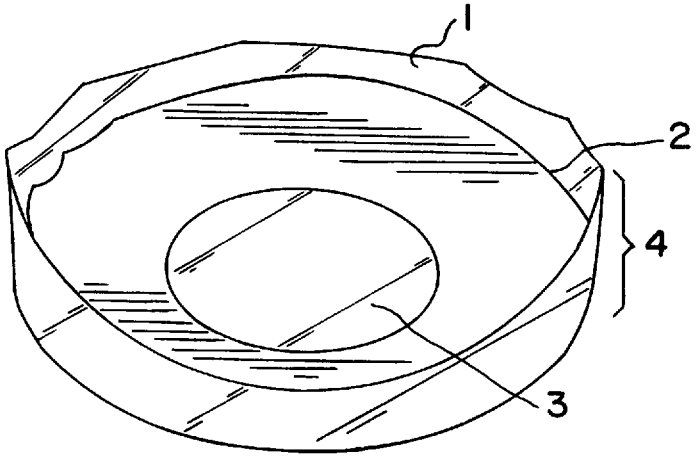

For sealing, the film cover is placed concentrically on the plastic disk and the projecting part of the film is bent around the outer periphery of the plastic disk. Immediately after the container has been filled with the polyurethane hotmelt adhesive, the plastic disk lined with the film is introduced into the container and pressed lightly onto the hotmelt adhesive so that the product rises about 2 to 4 mm at its edges, the surface of the disk covered with the film facing the hotmelt adhesive. The plastic disk performs two important functions. Firstly, as a centering aid, it facilitates the dimensionally accurate positioning of the cover film on the hotmelt adhesive, particularly at its periphery. An additional effect was surprisingly observed, enabling the above-mentioned disadvantage of surface covering according to the prior art to be overcome. Accordingly, this effect may be regarded as the principal function of the plastic disk. If the plastic disk is made of a thermoplastic material of high specific thermal expansion, it expands when the heat of the hotmelt adhesive flows into the disk. A radial pressure is built up over a period of several hours, during which the hotmelt cools, and presses the vertically extending portion of the cover film against the wall of the container. Now, the hotmelt adhesive which has risen in this peripheral zone establishes an intimate and tight seal between the edge of the film and the inside of the container wall. At the same time, the plastic disk expands upwards or arches in the middle. This pressing-on of the cover film over the entire cooling phase ensures that the film adheres firmly, even at its periphery, and is capable of bridging a deep gap formed between the wall of the container and the hotmelt adhesive, so that the entire hotmelt adhesive is sealed in moisture-tight manner.

The film material must be capable of developing a good barrier effect against water vapor and, in addition, should have such high thermal stability that it is not damaged by the high temperatures of the cooling hotmelt. Accordingly, only multilayer composite films are generally suitable for the cover film. Although two-layer composite films may also be used, films consisting of at least three layers have proved to be particularly suitable. That side of the composite film which faces the hotmelt adhesive should have anti-adhesive properties so that the composite film can readily be removed from the solidified hotmelt by the end user before the adhesive is applied. Accordingly, this inner layer which faces the solidified hotmelt adhesive, consists of polyethylene, polytetrafluoroethylene (PTFE) or, more particularly, polypropylene. The middle layer of the three-layer composite film consists of an aluminium foil as the water vapour barrier. The outside of the composite film is intended to provide the film as a whole with sufficiently high mechanical strength, so that polyamide films or, more particularly, polyester films are preferably used for this side. The composite films suitable for use in accordance with the invention must be laminated in such a way that the composite film is capable of withstanding the high temperatures prevailing during the cooling phase of the hotmelt adhesive, so that the films are preferably laminated with a laminating adhesive, for example Liofol (RTM, Henkel KGaA).

As mentioned above, the plastic disk—through its linear thermal expansion—is intended to press the projecting margin of the cover film radially against the inner wall of the container. For this reason, thermoplastics with a linear expansion coefficient of at least $6\times10^{-5}$/K, as measured at room temperature, are suitable. This linear expansion coefficient should preferably be even higher at relatively high temperatures. This is guaranteed above all in the case of branched polyethylene or even in the case of polypropylene, so that polyethylene and, more particularly, polypropylene are suitable materials for the plastic disks. The outer dimensions of the plastic disk are governed by the container to be sealed. The thickness of the plastic disk is not critical providing adequate mechanical stability is guaranteed. The disk may be between 0.1 and 5 mm thick and is preferably from 1 to 3 mm thick.

In one particularly preferred embodiment, the plastic disk has an inner circular cutout which makes the insert easier to handle during its insertion after filling of the container and during its withdrawal before removal of the hotmelt adhesive.

The dimensions of the plastic film and the plastic disk are governed by the container to be sealed. In the case of a standard industrial-grade tin container with an internal diameter of 280 mm, a circular three-layer composite film with a diameter of 310 mm, for example, is used as the plastic film.

A polypropylene disk 275 mm in diameter and 2 mm thick is used as the plastic disk, the polypropylene disk having an inner circular cutout of around 125 mm.

For containers with different dimensions, the film and the plastic disk correspondingly assume other dimensions.

In order to guarantee the processor even greater safety against the formation of a skin on the hotmelt adhesive, a small bag containing a molecular sieve may be placed on the above-described insert consisting of the film and plastic disk after the hotmelt adhesive has been introduced into the container and sealed with the insert. The molecular sieve removes the residual moisture present in the gas space between the insert and the lid of the container. In addition, by conducting a simple functional test on the molecular sieve, the processor is able to tell whether the container was tight. To this end, the processor moistens the small bag containing the molecular sieve before application of the adhesive. If the molecular sieve undergoes considerable heating on moistening, it still has a high adsorption capacity for water at this stage which is a reliable sign of adequate tightness of the container.

To apply the hotmelt adhesive, the processor opens the tin container, removes plastic disk and is able to peel the sealing film from the solidified hotmelt adhesive without significant effort. Since the plastic disk is not soiled, it may be reused for the same purpose. The hotmelt adhesive may now be readily removed by any conventional drum press with a heatable follower plate.

In this way, the container can be completely emptied apart from minor residues so that reuse or disposal of the container is generally not problematical. It can be made even easier by covering the bottom of the container with a suitable composite film before it is filled with the polyurethane hotmelt adhesive. After removal of the hotmelt, the small residue remaining at the bottom of the container can be effortlessly removed after cooling so that the bottom of the container remains clean and, accordingly, is easy to reuse or dispose of.

A preferred embodiment of the insert to be used for the process according to the invention for sealing containers is described in more detail in the following with reference to FIGS. 1 and 2 of the accompanying drawings.

FIG. 1 is a semiperspective view of the insert consisting of the composite film 1 bent at its periphery 4 around the plastic film and of the plastic disk 2 with its central circular cutout 3.

Figure 2:
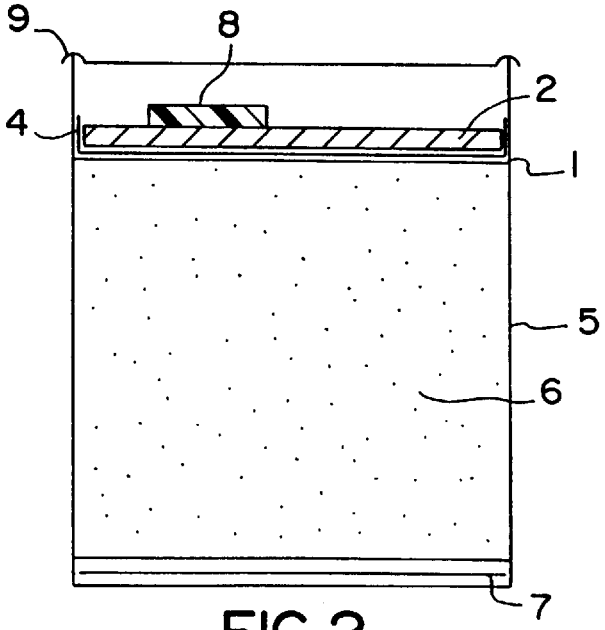

FIG. 2 shows the container filled with the hotmelt adhesive and sealed. The composite film 1 faces the hotmelt adhesive 6 on its antiadhesive side. The plastic disk 2 lies on the composite film 1 and, during the cooling phase, presses the upwardly bent periphery 4 of the composite film 1 firmly against the wall 5 of the container. The small quantity of hotmelt adhesive present between the upwardly bent periphery 4 of the composite film and the inside of the container wall 5 is not shown in FIG. 2. The additional composite film 7 inserted at the base of the container, the small bag 8 filled with molecular sieve and the lid 9 closing the container are also shown.

Although the above-described embodiments for sealing containers containing fusible materials represent the preferred embodiments of the invention, any expert will appreciate that the invention can also be applied with advantage in other embodiments. For example, the plastic disk can be removed from the film after the hotmelt has cooled and before the lid of the container is fitted to seal the container because the film—by virtue of its reliable peripheral bonding/sealing effect—affords adequate protection against penetrating moisture during storage of the container, even without the plastic disk. In this case, the plastic disk remains with the adhesive manufacturer/packer and may be directly returned to the container filling process.

The sealing process according to the invention is not limited in its application to reactive hotmelt adhesives, instead other fusible materials which have to be safely protected against moisture, air or even contamination can be sealed in this way in containers with the sole proviso that they are packed at sufficiently high temperatures. In general, the surface temperature of the material to be sealed should be at least 50° C. and preferably 80° C. so that the plastic disk—through its thermal expansion—applies a sufficiently high pressure to the film at its periphery. If the materials to be sealed are not hotmelt adhesives, the periphery of the film which is to be sealed/bonded to the inner wall of the container may advantageously be coated with a heatsealable coating, for example a hotmelt adhesive. In this way, these materials are also guaranteed a reliable peripheral sealing/bonding effect.

What is claimed is:

1. A process for filling and self-sealing containers comprising filling a container with a molten material and covering a top surface of the molten material which is still at elevated temperature after filling with an insert consisting of a plastic film and a plastic disk, said plastic film facing the molten material and being larger than said plastic disk, the diameter of said plastic disk being slightly smaller than an internal diameter of said container, placing said plastic disk on said plastic film in order to press said plastic film against a container wall.

2. A process as claimed in claim 1 wherein said plastic film is an at least two-layer composite film and said plastic disk consists of a plastic with a linear expansion coefficient of at least $6 \cdot 10^{-5}$/K.

3. A process as claimed in claim 2, wherein said plastic film is a three-layer composite film of an inner layer selected from the group consisting of a polypropylene film, a polyethylene film or polytetrafluoroethylene film, a middle layer of an aluminum foil, and an outer layer selected from the group consisting of a polyester film and a polyamide film.

4. A process as claimed in claim 2 wherein said plastic disk consists of a member selected from the group consisting of polyvinyl chloride, polystyrene, polyethylene, polypropylene, polymethyl methacrylate, and polyoxymethylene.

5. A process as claimed in claim 4 wherein said plastic disk has a thickness of 0.1 to 5 mm.

6. A process as claimed in claim 4 wherein said plastic disk has a thickness of 1 to 3 mm.

7. A process as claimed in claim 1 wherein said plastic disk has an inner cutout.

8. A process as claimed in claim 7 wherein said inner cutout is circular.

9. A process as claimed in claim 8 wherein said elevated temperature is least 80° C.

10. A process as claimed in claim 9 further comprising, after said covering, placing a small bag filled with a molecular sieve on said insert and subsequently closing the container with a lid.

11. A process as claimed in claim 1 wherein said insert is pressed onto the still warm surface of the molten material in such a way that a portion of the melt rises about 1 to 4 mm at its periphery.

12. A process as claimed in claim 1 further comprising, after the molten material has cooled to ambient temperature, removing the plastic disk and subsequently closing the container with a lid.

13. A process as claimed in claim 1 wherein the projecting part of said plastic film is bent around the outer periphery of the plastic disk.

14. A process as claimed in claim 1 wherein the heat of the molten material adhesive flows into said plastic disk and said plastic disk expands such that a radial pressure is built up and presses the projecting part of said plastic film against the wall of the container.

15. A process as claimed in claim 14 wherein a portion of said molten material rises between said projecting part of said plastic film and the inside of the container wall and establishes an intimate and tight seal between the edge of the film and said inside of the container wall.

16. A process for filling and self-sealing containers comprising filling a container with a molten material and covering a top surface of the molten material which is still at elevated temperature after filling with an insert consisting of a plastic film and a plastic disk, said plastic film facing the molten material and being larger than said plastic disk and the diameter of said plastic disk being sufficiently smaller than the internal diameter of said container such that a projecting part of said plastic film is bent around an outer periphery of said plastic disk, wherein heat from the molten material flows into said plastic disk and said plastic disk expands such that a radial pressure is built up and presses the projecting part of said plastic film against a wall of the container, and wherein a portion of said molten material rises between said projecting part of said plastic film and an inner wall of the container and establishes an intimate and tight seal between the edge of the film and said inner wall of the container.

17. A packed hotmelt adhesive which is the product of the process of claim 1.

* * * * *